US009362640B2

(12) United States Patent
Nishio et al.

(10) Patent No.: US 9,362,640 B2
(45) Date of Patent: Jun. 7, 2016

(54) CARD EDGE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akihiro Nishio, Mie (JP); Masaaki Tabata, Mie (JP); Masanori Moriyasu, Mie (JP); Yasuo Omori, Mie (JP); Hajime Matsui, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/652,498

(22) PCT Filed: Jun. 7, 2013

(86) PCT No.: PCT/JP2013/065887

§ 371 (c)(1),
(2) Date: Jun. 16, 2015

(87) PCT Pub. No.: WO2014/103403

PCT Pub. Date: Jul. 3, 2014

(65) Prior Publication Data

US 2015/0340786 A1 Nov. 26, 2015

(30) Foreign Application Priority Data

Dec. 28, 2012 (JP) ..... 2012-287421

(51) Int. Cl.
*H01R 12/00* (2006.01)
*H01R 12/72* (2011.01)

(Continued)

(52) U.S. Cl.
CPC ..... *H01R 12/721* (2013.01); *H01R 12/714* (2013.01); *H01R 13/5208* (2013.01);

(Continued)

(58) Field of Classification Search
USPC ..... 439/76.1, 382
See application file for complete search history.

(56) References Cited

U.S. PATENT DOCUMENTS 3,784,963 A * 1/1974 DeCenzo ..... H01R 31/02 439/712
6,955,544 B2 * 10/2005 Miquel ..... H05K 7/142 361/752

(Continued)

FOREIGN PATENT DOCUMENTS

| | | |
|---|---|---|
| JP | 7-245155 | 9/1995 |
| JP | 8-185920 | 7/1996 |
| JP | 2000-194797 | 7/2000 |
| JP | 2001-101347 | 4/2001 |

(Continued)

OTHER PUBLICATIONS

International Search Report of Sep. 10, 2013.

*Primary Examiner* — Tho D Ta
(74) *Attorney, Agent, or Firm* — Gerald E. Hespos; Michael J. Porco; Matthew T. Hespos

(57) ABSTRACT

A card edge connector includes a harness-side connector (H) in which a plurality of terminal fittings (50) are arranged side by side in a harness-side housing (10) and a board-side connector (P) in which a connecting edge portion (63) of a circuit board (62) projects from a front surface (60F) of a board-side housing (60). The harness-side housing (10) includes a terminal accommodating portion (39) configured to accommodate the plurality of terminal fittings (50), and a housing accommodating portion (48) arranged to face a front surface (39F) of the terminal accommodating portion (39) and configured to accommodate the board-side housing (60) connected to the harness-side housing (10). A resilient member (49) configured to bias the terminal accommodating portion (39) and the board-side housing (60) in a direction toward or away from each other in parallel to a connecting direction is provided in the housing accommodating portion (48).

6 Claims, 7 Drawing Sheets

(51) Int. Cl.

| | |
|---|---|
| ***H01R 12/71*** | (2011.01) |
| ***H01R 13/52*** | (2006.01) |
| *H01R 13/533* | (2006.01) |
| *H01R 33/975* | (2006.01) |
| *H01R 13/422* | (2006.01) |
| *H01R 13/627* | (2006.01) |
| *H01R 13/64* | (2006.01) |

(52) U.S. Cl.

CPC ..... *H01R13/5213* (2013.01); *H01R 12/724* (2013.01); *H01R 13/4223* (2013.01); *H01R 13/533* (2013.01); *H01R 13/6272* (2013.01); *H01R 13/64* (2013.01); *H01R 33/975* (2013.01)

(56) References Cited

U.S. PATENT DOCUMENTS

| | | | | |
|---|---|---|---|---|
| 8,545,238 | B2 * | 10/2013 | Takeda | H01R 12/724 439/377 |
| 2014/0294349 | A1 | 10/2014 | Nishio et al. | |
| 2014/0305691 | A1 * | 10/2014 | Nishio | H01R 12/75 174/541 |

FOREIGN PATENT DOCUMENTS

| | | |
|---|---|---|
| JP | 2001-145233 | 5/2001 |
| JP | 2008-91047 | 4/2008 |
| JP | 2012-252889 | 12/2012 |

* cited by examiner

CARD EDGE CONNECTOR

BACKGROUND

1. Field of the Invention

The present invention relates to a card edge connector.

2. Description of the Related Art

Japanese Unexamined Patent Publication No. 2008-091047 discloses a card edge connector formed by connecting a harness-side connector in which a plurality of terminal fittings are arranged side by side in a harness-side housing and a board-side connector in which a circuit board is mounted on a board-side housing. When the two housings are connected, the plurality of terminal fittings are resiliently held in contact with a plurality of contact portions arranged side by side on an edge part of the circuit board.

If vibration is applied to the card edge connector as described above, the harness-side housing and the board-side housing are relatively displaced in a connecting direction, whereby position shifts caused by vibration occur between the terminal fittings and the contact portions. Thus, if vibration is intermittently received over a long time, it may result in contact failures between the terminal fittings and the contact portions.

The present invention was developed in view of the above situation and aims to improve the contact reliability of a circuit board and harness-side terminal fittings.

SUMMARY OF THE INVENTION

The present invention is directed to a card edge connector with a harness-side connector in which a plurality of terminal fittings are arranged side by side in a harness-side housing and a board-side connector in which a connecting edge portion of a circuit board projects from a front surface of a board-side housing, the plurality of terminal fittings being resiliently brought into contact with a plurality of contact portions arranged side by side on the connecting edge portion when the board-side housing is connected to the harness-side housing from front of the harness-side housing, including a terminal accommodating portion constituting the harness-side housing and configured to accommodate the plurality of terminal fittings, a housing accommodating portion constituting the harness-side housing, arranged to face a front surface of the terminal accommodating portion and configured to accommodate the board-side housing connected to the harness-side housing, and a resilient member provided in the housing accommodating portion and configured to bias the terminal accommodating portion and the board-side housing in a direction toward or away from each other in parallel to a connecting direction.

According to this configuration, relative displacements of the board-side housing and the terminal accommodating portion are restricted by a biasing force of the resilient member when the board-side housing is connected to the harness-side housing and accommodated into the housing accommodating portion. Since this prevents position shifts between the terminal fittings and the circuit board due to vibration resulting from the relative displacements of the two housings, the contact reliability of the terminal fittings and the circuit board is excellent.

DETAILED DESCRIPTION

Figure 1:
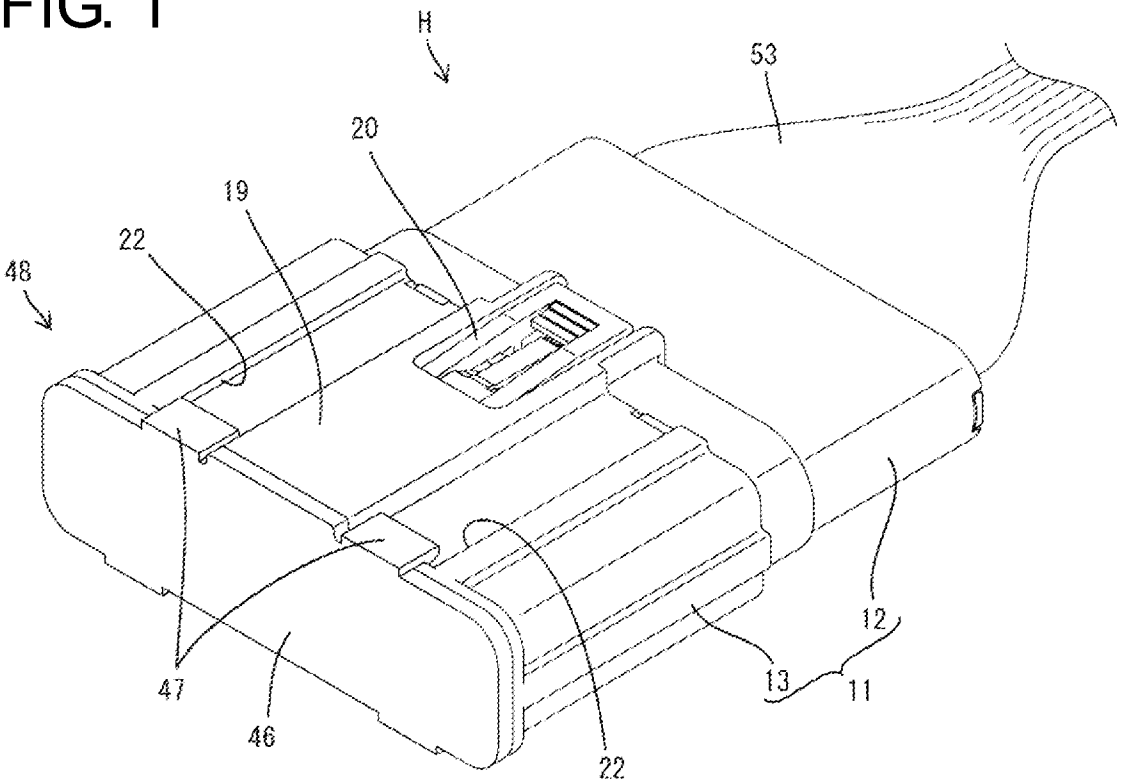
FIG. 1 is a perspective view of a card edge connector of one embodiment.

In the card edge connector of the present invention, the housing accommodating portion may include a receptacle integrated with the terminal accommodating portion and projecting forwardly of the terminal accommodating portion and a cap to be mounted on the receptacle to close an opening on a front end of the receptacle.

According to this configuration, since the board-side housing is accommodated into the receptacle when being connected to the harness-side housing, the board-side housing can be positioned with respect to the harness-side housing so as not to be relatively displaced until the cap is mounted.

In the card edge connector of the present invention, the resilient member may be arranged between a rear surface of the board-side housing in the receptacle and an inner surface of the cap.

According to this configuration, the board-side housing is pressed toward the terminal accommodating portion by being biased from the rear surface side thereof by the resilient member and relative displacements of the harness-side housing and the board-side housing are restricted by this pressing action. A projecting distance of the circuit board from the board-side housing can be made shorter as compared with the case where the resilient member is interposed between a front surface of the harness-side housing and the front surface of the board-side housing.

In the card edge connector of the present invention, the resilient member may be a component separate from the housing accommodating portion and accommodated in the housing accommodating portion.

In the case of integrally forming the component constituting the housing accommodating portion and the resilient member, there are restrictions such as the possibility of mold removal, resilient strength and the like. Thus, a degree of freedom in design is low. Contrary to this, in this embodiment, the resilient member is a component separate from the housing accommodating portion according to the above configuration. Thus, a degree of freedom is high in designing the housing accommodating portion and the resilient member.

In the card edge connector of the present invention, the board-side housing may be integrated with the circuit board by molding.

According to this configuration, since there is no relative displacement between the board-side housing and the circuit board, a relative displacement of the circuit board to the terminal fittings can be reliably restricted if relative displacements of the board-side housing and the harness-side are restricted.

In the card edge connector of the present invention, the housing accommodating portion may include a receptacle integrated with the terminal accommodating portion and projecting forwardly of the terminal accommodating portion, and the entire board-side housing may be accommodated in the receptacle in a state where the harness-side connector and the board-side connector are properly connected.

According to this configuration, the board-side housing can be protected from the interference of external matters after the harness-side connector and the board-side connector are properly connected.

<Embodiment>

Figure 2:
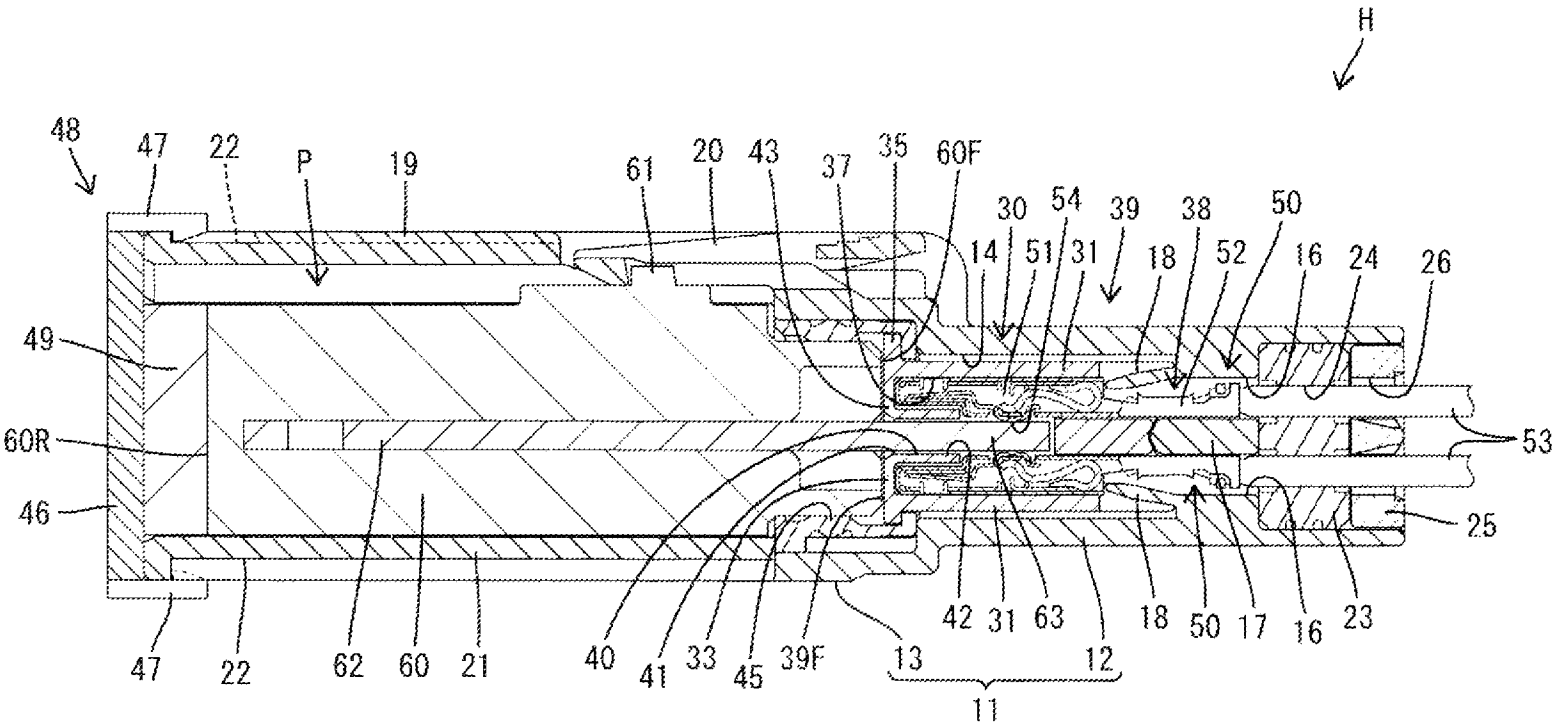
FIG. 2 is a side view in section of the card edge connector.
Figure 3:
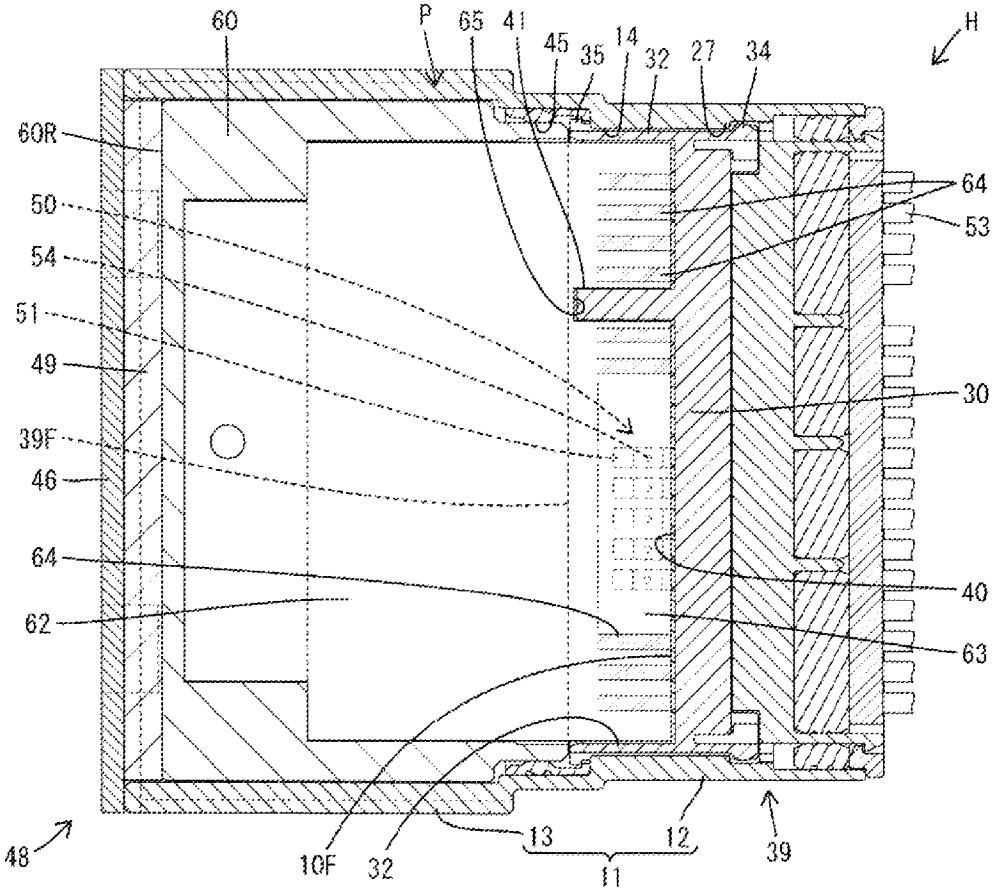
FIG. 3 is a plan view in section of the card edge connector.

Hereinafter, one specific embodiment of the present invention is described with reference to FIGS. 1 to 7. A card edge connector of this embodiment includes a harness-side connector H and a board-side connector P as shown in FIGS. 2 and 3. The board-side connector P is connected to the harness-side connector H from front of the harness-side connector H. In the following description, forward and backward directions are based on the harness-side connector H. Further, a front-back direction and a connecting direction of the two connectors H, P are synonymous.

<Harness-Side Connector H>

The harness-side connector H includes a harness-side housing 10, a plurality of terminal fittings 50 and as many wires 53 as the terminal fittings 50. The plurality of terminal fittings 50 are accommodated in the harness-side housing 10 while being arranged side by side at a predetermined interval in a lateral direction (width direction). The wire 53 is connected to a rear end part of each terminal fitting 50. These wires 53 are drawn out backwardly of the harness-side housing 10.

<Harness-Side Housing 10>

The harness-side housing 10 includes a housing main body 11, a one-piece rubber plug 23, a rear holder 25, a terminal holding member 30, a seal ring 45, a cap 46 and a resilient member 49. These components 11, 23, 25, 30, 45 and 46 are assembled.

Figure 6:
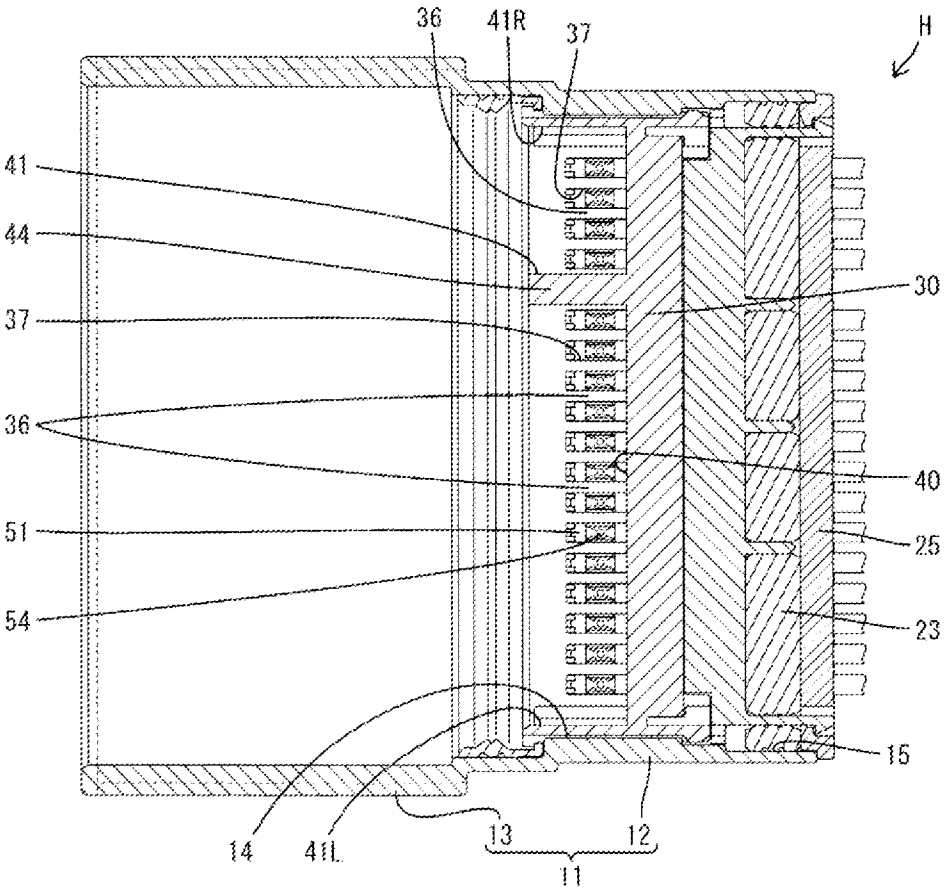
FIG. 6 is a section along X-X of FIG. 5.
Figure 7:
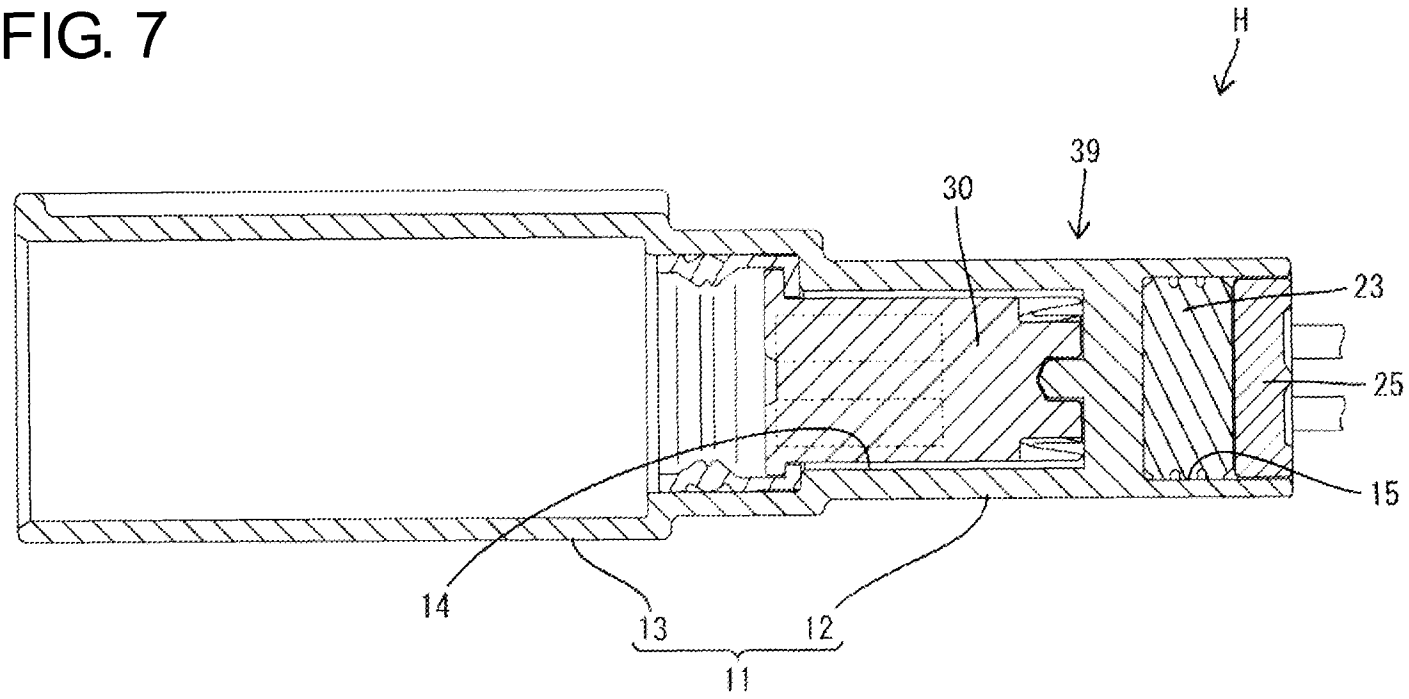
FIG. 7 is a section along Y-Y of FIG. 5.

The housing main body 11 is made of PBT (polybutylene terephthalate) resin material to form resiliently deflectable locking lances 18 to be described later. A liner expansion coefficient of the PBT resin is about 100 ppm/° C. The housing main body 11 has a flat outer shape as a whole in which a height (vertical dimension) is smaller than a width and a dimension in the front-back direction. The housing main body 11 is configured by integrally forming a main body portion 12 and a receptacle 13 projecting forward in a cantilever manner from the outer peripheral edge of the front end of the main body portion 12. As shown in FIGS. 6 and 7, a single front space 14 formed by recessing a substantially entire area of the front end surface of the main body portion 12 is formed in the main body portion 12. The terminal holding member 30 is accommodated in the front space 14. Further, a single rear space 15 formed by recessing a substantially entire area of the rear end surface of the main body portion 12 is formed in the main body portion 12.

As shown in FIG. 2, a plurality of rear cavities 16 allowing the front and rear spaces 14, 15 of the main body portion 12 to communicate are formed between the two spaces 14 and 15. The plurality of rear cavities 16 are arranged side by side at a predetermined interval in the width direction in each of two upper and lower stages. The rear cavities 16 in the upper stage and those in the lower stage are partitioned by a separation wall 17. Further, the locking lances 18 cantilevered obliquely forward from the front ends of the respective rear cavities 16 and located in the front space 14 are formed in the main body portion 12. The locking lances 18 are resiliently deflectable in the vertical direction (direction intersecting with an inserting direction of the terminal fittings 50 into the harness-side housing 10).

An inner space of the receptacle 13 communicates with the front space 14 of the main body portion 12. The board-side connector P is accommodated into the receptacle 13 from front of the receptacle 13. A lock arm 20 is formed on an upper wall portion 19 constituting the receptacle 13. The lock arm 20 is resiliently deflectable in the vertical direction (direction intersecting with the connecting direction of the two connectors H, P). Further, locking recesses 22 are formed on the upper wall portion 19 and a lower wall portion 21 constituting the recess 13 by recessing outer surfaces of front end parts of these wall portions in a step manner.

As shown in FIG. 2, the one-piece rubber plug 23 and the rear holder 25 are accommodated in the rear space 15. The one-piece rubber plug 23 is formed with a plurality of seal holes 24 separated in two upper and lower stages and penetrating in the front-back direction. The one-piece rubber plug 23 is held in close contact with the inner peripheral surface of the rear space 15 in a liquid-tight manner to seal. The rear holder 25 is assembled with the housing main body 11 in a state arranged behind and near the one-piece rubber plug 23. The rear holder 25 restricts backward separation of the one-piece rubber plug 23. The rear holder 25 is formed with a plurality of through holes 26 corresponding to the respective seal holes 24.

<Terminal Holding Member 30>

Since the terminal holding member 30 has a linear expansion coefficient which is nearly equal to that of a circuit board 62, it is made of a glass-containing PPS (polyphenylene sulfide) resin material. A linear expansion coefficient of the glass-containing PPS resin is approximately 10 to 30 ppm/° C. (e.g. Torelina (registered trademark), which is PPS resin produced by Toray Industries, Inc., has a linear expansion coefficient of 23 ppm/° C. in a flowing direction and a linear expansion coefficient of 31 ppm/° C. in a perpendicular direction). The linear expansion coefficient of the glass-containing PPS resin of the terminal holding member 30 is about 1/10 to 3/10 of that of the PBT resin of the housing main body 11. The terminal holding member 30 has a flat shape as a whole in which a height (vertical dimension) is set to be smaller than a width. As shown in FIGS. 2 and 3, the terminal holding member 30 is a single component including a pair of upper and lower supporting wall portions 31, a pair of left and right side wall portions 32 and a front wall portion 33. The pair of side wall portions 32 couple opposite left and right end edges of the upper and lower supporting wall portions 31. The front wall portion 33 couples front end edges of the both supporting wall portions 31 and is connected to the front ends of the side wall portions 32. Any of these wall portions 31, 32 and 33 constitutes an outer wall surface of the terminal holding member 30.

The terminal holding member 30 is accommodated in the front space 14. As shown in FIG. 3, resilient locking pieces 34 formed on the outer surfaces of the left and right side wall portions 32 of the terminal holding member 30 are locked to locking steps 27 formed on opposite left and right inner side surfaces of the front space 14. By the locking action of these resilient locking pieces 34 and the locking steps 27, the terminal holding member 30 is held in the front space 14. As shown in FIGS. 2 and 3, a flange portion 35 is formed on the outer periphery of a front end portion of the terminal holding member 30. A rear end part of the seal ring 45 made of rubber is locked to this flange portion 35. By this locking action, the seal ring 45 is mounted on the housing main body 11 in a state where the outer periphery thereof is held in close contact with the inner periphery of a rear end part of the receptacle 13 and the seal ring 45 is arranged before the terminal holding member 30.

As shown in FIG. 6, a plurality of rib-like partition walls 36 projecting from the inner surfaces of the both supporting wall portions 31 toward a vertical center are formed in the terminal holding member 30. The partition walls 36 are long and narrow in the front-back direction and arranged side by side in the lateral direction. Spaces defined by the supporting wall portions 31 and the partition walls 36 serve as front cavities 37. Thus, a plurality of (as many as the rear cavities 16) front cavities 37 separated in two upper and lower stages are arranged side by side at a predetermined interval (same interval as the rear cavities 16) in the width direction in the terminal holding member 30. The inner surfaces of the supporting wall portions 31 and the side surfaces of the partition walls 36 are directly facing the front cavities 37. The plurality of front cavities 37 and the plurality of rear cavities 16 are arranged in one-to-one correspondence in the front-back direction to form terminal accommodating chambers 38. The main body portion 12 of the housing main body 11 and the terminal holding member 30 form a terminal accommodating portion 39 for accommodating the plurality of terminal fittings 50 arranged side by side.

As shown in FIG. 2, a space between the front cavities 37 in the upper stage and those in the lower stage out of the inner space of the terminal holding member 30 serves as a single board accommodation space 40 in which a vertical dimension is set to be smaller than a lateral dimension. The front cavities 37 in the upper stage and those in the lower stage are directly facing the board accommodation space 40. A board insertion port 41 which is in the form of a slit long and narrow in the lateral direction is formed to penetrate through the front wall portion 33 in the front-back direction. The front end of the board accommodation space 40 communicates with the board insertion port 41.

Further, the front wall portion 33 is formed with a pair of upper and lower receiving plate portions 42 for supporting front end parts of box portions 51 of the terminal fittings 50 accommodated in the front cavities 37. The receiving plate portions 42 are cantilevered backwardly from a pair of upper and lower long-side opening edges 43 extending in the lateral direction (length direction of the board accommodation space 41) out of opening edges of the board accommodation space 41. In a state where the box portions 51 of the terminal fittings 50 are accommodated in the front cavities 37, displacements of the front end parts of the box portions 51 toward the board accommodation space 40 are restricted by the receiving plate portions 42. In this way, the terminal fittings 50 are held not to be inclined in the vertical direction.

Figure 5:
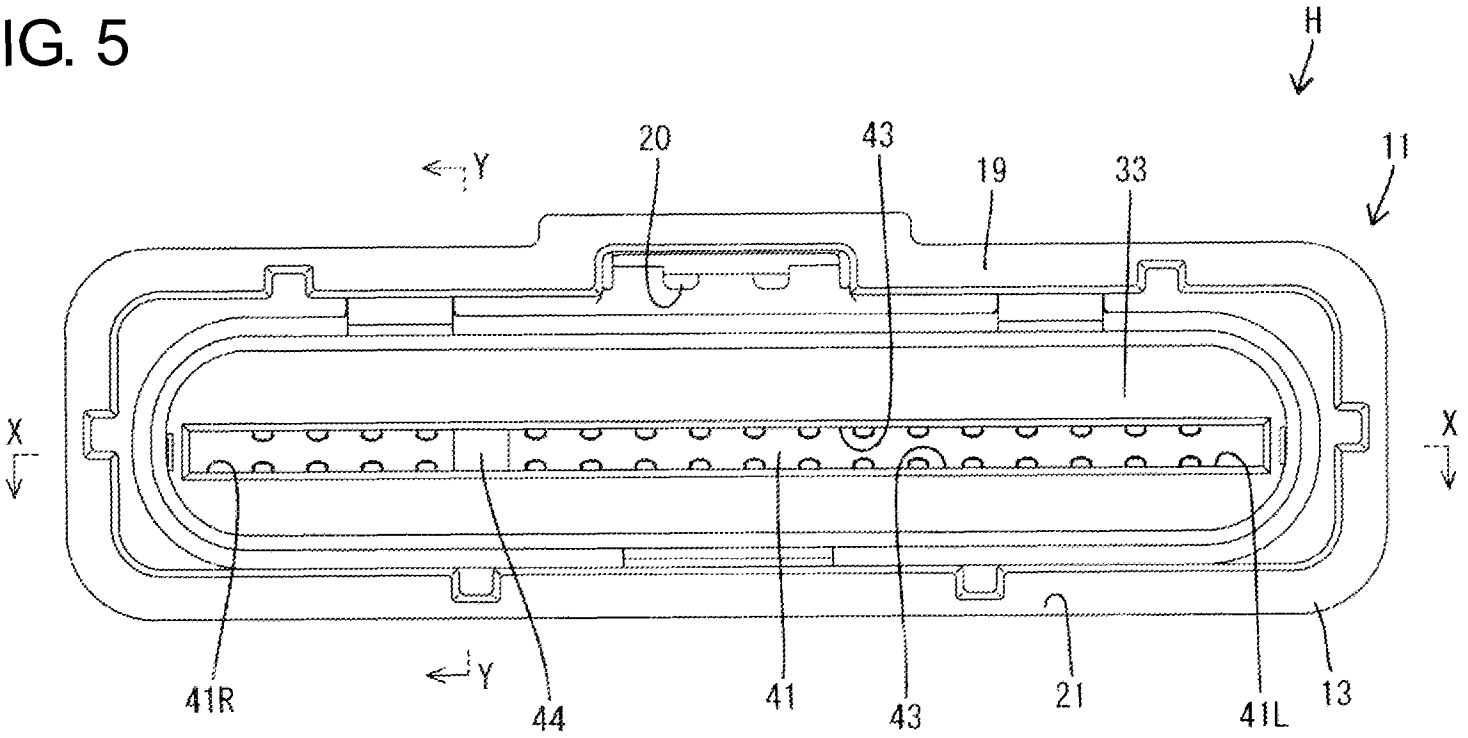
FIG. 5 is a front view of the harness-side connector.

Since the front ends of the supporting wall portions 31 are connected to the front wall portion 33, the front wall portion 33 is deformed to be vertically expanded if the supporting wall portions 31 are deformed to bulge toward outer surface sides of the terminal holding member 30 (upwardly or downwardly). Associated with this deformation of the front wall portion 33, the upper and lower long-side opening edges 43 of the board insertion port 41 are relatively displaced away from each other. In this embodiment, the front wall portion 33 is formed with one coupling portion 44 for coupling the long-side opening edges 43 as shown in FIGS. 3, 5 and 6 as a means for preventing the board insertion port 41 from being deformed to be vertically widened.

The front end edge of the coupling portion 44 is connected to the front wall portion. The upper end edge of the coupling portion 44 is connected to the upper supporting wall portion 31. The lower end edge of the coupling portion 44 is connected to the lower supporting wall portion 31. The rear end edge of the coupling portion 44 is connected to the front end of the separation wall 17. That is, the coupling portion 44 is connected in an entire area from the front ends to the rear ends of the pair of upper and lower supporting wall portions 31. Thus, deformation of the upper and lower supporting wall portions 31 away from each other is restricted by this coupling portion 44.

Further, by being formed with the coupling portion 44, the board insertion port 41 is divided into two left and right opening areas 41L, 41R. Accordingly, two (a plurality of) opening areas 41L, 41R correspond to the board accommodation space 40 as a single space. The coupling portion 44 is arranged at a position deviated in the lateral direction from a central position of the long-side opening edges 43 in the length direction. That is, the coupling portion 44 is asymmetrically arranged in the lateral direction. The shapes and sizes of the two opening areas 41L, 41R are asymmetrical in the lateral direction.

As shown in FIG. 2, the cap 42 made of synthetic resin is mounted on the receptacle 13 to close an opening on the front end of the receptacle 13 from front. A board-side housing 60 is entirely accommodated in the receptacle 13 in a state where the both connectors H, P are properly connected. Thus, the cap 46 is in the form of a flat plate as a whole. A lock arm 47 is formed on each of upper and lower end edges of the cap 46. The cap 46 mounted on the receptacle 13 is held so as not be separated forwardly from the receptacle 13 by locking the lock arms 47 to the locking recesses 22 of the receptacle 13. This cap 46 and the receptacle 13 constitute a housing accommodating portion 48 for accommodating the board-side housing 60.

The housing accommodating portion 48 is arranged before and adjacent to the terminal accommodating portion 39. Further, an inner space of the housing accommodating portion 48 communicates with the board accommodation space 40 via the board insertion port 41. The resilient member made of a rubber material is accommodated in the housing accommodating portion 48. The resilient member 49 is arranged to be held in close contact with a substantially entire area of the inner surface (rear surface) of the cap 46. The rear surface of the resilient member 49 is held in close contact with a substantially entire area of a rear surface 60R of the board-side housing 60. When the cap 46 is mounted on the receptacle 13, the resilient member 49 is sandwiched between the cap 46 and the board-side housing 60 to be resiliently squeezed.

<Terminal Fitting 50>

The terminal fitting 50 is formed into a long and narrow shape in the front-back direction (direction perpendicular to a juxtaposition direction of the terminal fittings 50) as a whole. The terminal fitting 50 is formed by bending and assembling two metal plate members punched out into predetermined shapes. As shown in FIG. 2, a front end side area of the terminal fitting 50 serves as the box portion 51 of a known form. A rear end side area of the terminal fitting 50 serves as a crimping portion 52 of a known form, and a front end part of the wire 53 constituting a wiring harness is connected to the crimping portion 52 by crimping. The box portion 51 includes a resilient contact piece 54. A part of the resilient contact piece 54 projects out from the box portion 51.

The terminal fitting 50 is inserted into the terminal accommodating chamber 38 by successively passing through the through hole 26 of the rear holder 25 and the seal hole 24 of the one-piece rubber plug 23. The inserted terminal fitting 50 has the rear end of the box portion 51 locked by the locking lance 18, thereby being retained and held. With the terminal fitting 50 inserted, the box portion 51 and the resilient contact piece 54 are arranged in the front cavity 37 and the crimping portion 52 is arranged in the rear cavity 16. That is, the box portion 51 (front end side part of the terminal fitting 50) is held over the entire length from the front end to the rear end thereof by the terminal holding member 30. Further, the crimping portion 52 (rear end side part of the terminal fitting 50) is arranged over the entire length thereof in the housing main body 11.

With the terminal fitting 50 inserted in each terminal accommodating chamber 38, a part of the resilient contact piece 54 projects toward a side opposite to the supporting wall portion 31 and is located in the board accommodation space 40. Further, each terminal fitting 50 is sandwiched from left and right sides by the partition walls 36 and positioned with respect to the terminal holding member 30 so as not to largely rattle in the lateral direction (juxtaposition direction).

<Board-Side Connector P>

Figure 4:
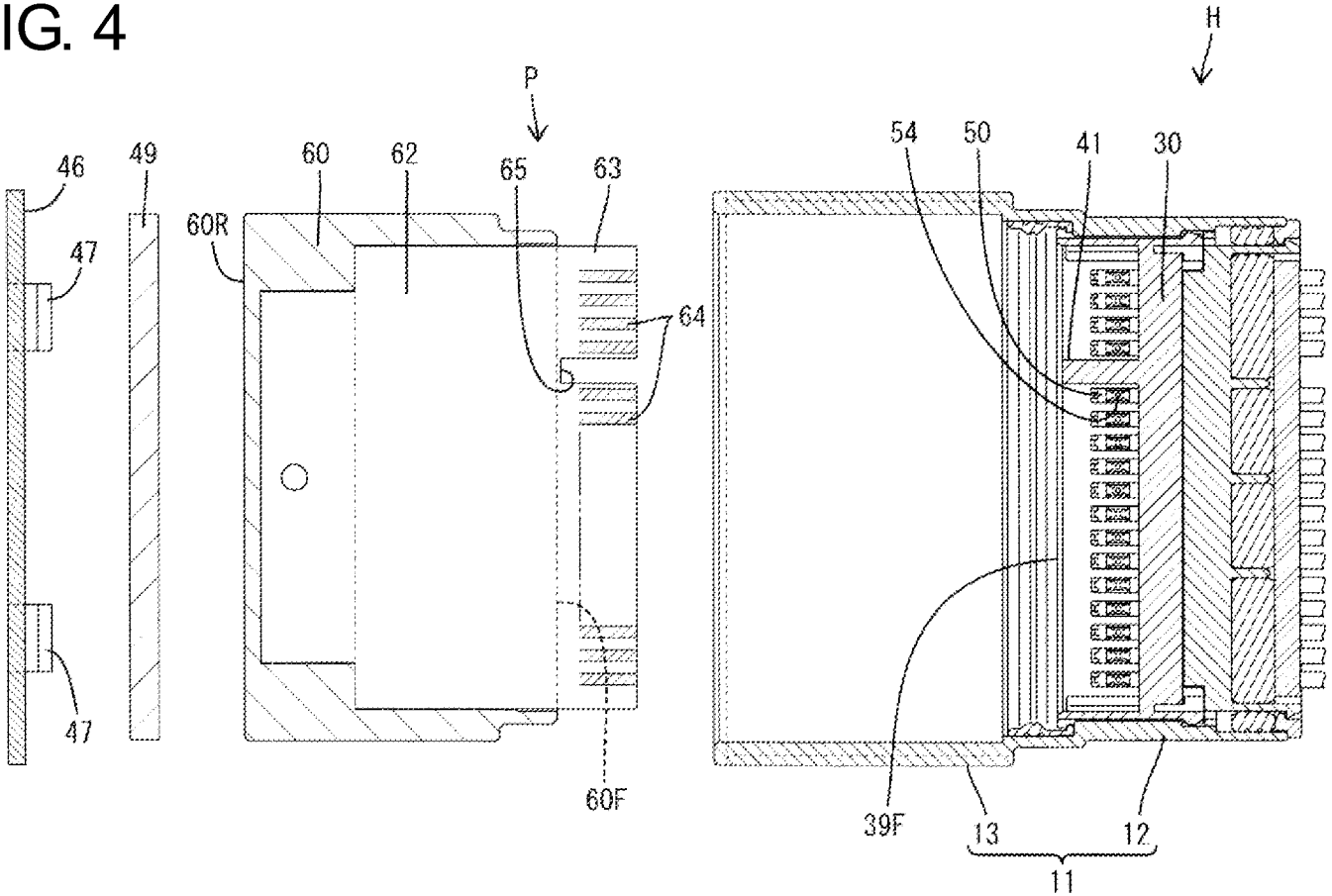
FIG. 4 is a plan view in section showing a state where a harness-side connector and a board-side connector are separated.

As shown in FIGS. 2 to 4, the board-side connector P is an integral assembly of the board-side housing 60 made of synthetic resin and the circuit board 62 by molding. The board-side housing 60 has a flat shape as a whole in which a height (vertical dimension) is set to be smaller than a width. As shown in FIG. 2, a lock projection 61 is formed on the upper surface (outer surface) of the board-side housing 60. Circuits are formed by printing and electronic components and the like (not shown) are mounted on opposite upper and lower surfaces (both sides) of the circuit board 62. An end edge part of the circuit board 62 on the side of the harness-side connector H serves as a connecting edge portion 63 as a connection means to the terminal fittings 50.

The circuit board 62 is made of a glass epoxy resin material. A linear expansion coefficient of the glass epoxy resin material is approximately 10 to 15 ppm/° C. substantially equal to that of the glass-containing PPS resin as the material of the terminal holding member 30. An entire area of the circuit board 62 except the connecting edge portion 63 is embedded in the board-side housing 60. Accordingly, the connecting edge portion 63 of the circuit board 62 projects from a front surface 60F of the board-side housing 60 toward the harness-side housing 10. As shown in FIGS. 3 and 4, a plurality of contact portions 64 constituting the circuits are arranged side by side at the same interval as the terminal fittings 50 on opposite upper end lower surfaces of the connecting edge portion 63. Further, the connecting edge portion 63 is formed with a cut portion 65 corresponding to the coupling portion 44 of the harness-side housing 10.

<Functions and Effects>

In connecting the harness-side connector H and the board-side connector P, the board-side connector P is inserted into the receptacle 13 with the cap 46 removed from the receptacle 13. In an inserting process, the connecting edge portion 63 of the circuit board 62 is inserted into the board accommodation space 40 through the board insertion port 41. At this time, the cut portion 65 and the coupling portion 44 are press-fitted and engaged. When the two connectors H, P are properly connected, they are locked in a connected state by the locking action of the lock arm 20 and the lock projection 61. Further, the resilient contact pieces 54 of the terminal fittings 50 in the upper and lower stages respectively resiliently come into contact with the contact portions 64 on the upper and lower surfaces of the connecting edge portion 63 and the circuit board 62 and the terminal fittings 50 are electrically conductively connected. Further, a clearance between the inner surface of the receptacle 13 and the outer surface of the board-side housing 60 is sealed by the seal ring 45.

After the board-side connector P is inserted into the receptacle 13, the resilient member 49 is held in close contact with the rear surface 60R of the board-side housing 60 and the cap 46 is brought into contact with the front surface of the resilient member 49 and mounted on the receptacle 13. Then, the resilient member 49 is resiliently deformed to be squeezed in the front-back direction, and a front surface 60F of the board-side housing 60 is resiliently pressed against the front surface 39F of the terminal accommodating portion 39 (terminal holding member 30) by a resilient restoring force of this resilient member 49. By this resilient pressing action, relative displacements of the two housings 10, 60 in the front-back direction are restricted. Further, relative displacements of the two housings 10, 60 in directions (vertical direction and lateral direction) intersecting with the connecting direction are also restricted. In the above way, the connection of the two connectors H, P is completed.

In the card edge connector of this embodiment, the harness-side housing 10 is provided with the terminal accommodating portion 39 for accommodating the plurality of terminal fittings 50 and the housing accommodating portion 48 arranged to face the front surface 39F of the terminal accommodating portion 39 and configured to accommodate the board-side housing 60. The resilient member 49 for biasing the terminal accommodating portion 39 and the board-side housing 60 in a direction toward each other in parallel to the connecting direction is provided in the housing accommodating portion 48.

According to this configuration, relative displacements of the board-side housing 60 and the terminal accommodating portion 39 are restricted by a biasing force of the resilient member 49, wherefore position shifts between the terminal fittings 50 and the circuit board 62 caused by vibration resulting from relative displacements of the two housings 10, 60 are prevented. Thus, the card edge connector of this embodiment is excellent in the contact reliability of the terminal fittings 50 and the circuit board 62.

Further, the housing accommodating portion 48 includes the receptacle 13 integrated with the terminal accommodating portion 39 and projecting forwardly of the terminal accommodating portion 39 and the cap 46 to be mounted on the receptacle 13 to close the opening on the front end of the receptacle 13. According to this configuration, when the two housings 10, 60 are connected, the board-side housing 60 is accommodated into the receptacle 13. Thus, the two housings 10, 60 can be positioned so as not to be displaced relative to each other until the cap 46 is mounted.

Further, the entire board-side housing 60 is accommodated into the receptacle 13 with the two connectors H, P properly connected. Thus, the board-side housing 60 can be protected from the interference of external matters until the resilient member 49 and the cap 46 are mounted after the two connectors H, P are connected.

Further, the resilient member 49 is arranged between the rear surface 60R of the board-side housing 60 in the receptacle 13 and the inner surface of the cap 46. According to this configuration, the board-side housing 60 is pressed against the terminal accommodating portion 39 by being biased from the side of the rear surface 60R by the resilient member 49, and relative displacements of the harness-side housing 10 and the board-side housing 60 are restricted by this pressing action. Thus, in the card edge connector of this embodiment, a projecting distance of the circuit board 62 from the board-side housing 60 can be made shorter as compared with the case where the resilient member 49 is interposed between the front surface 39F of the terminal accommodating portion 39 and the front surface 60F of the board-side housing 60.

Further, the resilient member 49 is produced as a component separate from the housing accommodating portion 48. This resilient member 49 is accommodated in the housing accommodating portion 48. If an attempt is made to integrally form a component constituting the housing accommodating portion 48 and the resilient member 49, there are restrictions such as the possibility of mold removal, resilient strength and the like. Thus, a degree of freedom in design is low. Contrary to this, in this embodiment, the resilient member 49 is a component separate from the housing accommodating portion 48. Thus, a degree of freedom is high in designing the housing accommodating portion 48 and the resilient member 49.

Further, since the board-side housing 60 is integrally formed to the circuit board 62 by molding, there is no relative displacement between the board-side housing 60 and the circuit board 62. Since relative displacements of the board-side housing 60 and the harness-side housing 10 are restricted by the resilient member 49, relative displacements of the terminal fittings 50 to the circuit board 62 are reliably restricted.

Further, since the resilient contact pieces 54 of the terminal fittings 50 are resiliently in contact with the circuit board 62 in a state where the terminal fittings 50 and the circuit board 62 are connected, reaction forces resulting from resilient restoring forces of the resilient contact pieces 54 are given toward the terminal fittings 50 from the side of the circuit board 62. These reaction forces are received by the supporting wall portions 31 located at sides of the terminal fittings 50 opposite to the circuit board 62. However, since the supporting wall portions 31 are provided along the plurality of terminal fittings 50 arranged side by side, the rigidity of the supporting wall portions 31 is reduced if a large number of terminal fittings 50 are arranged side by side and the supporting wall portions 31 have a large width. In this case, the supporting wall portions 31 may be curved and deformed to bulge out in directions away from the circuit board 62 (upward or downward) without being able to receive the reaction forces from the side of the circuit board 62. If such deformation occurs, a contact pressure between the terminal fittings 50 and the circuit board 62 may be reduced.

Accordingly, in this embodiment, the pair of long-side opening edges 43 substantially parallel to the supporting wall portions 31 out of the opening edges of the board insertion port 41 are coupled by the coupling portion 44, focusing on the board insertion port 41 of the front wall portion 33 connected to the front end edges of the supporting wall portions 31. Since vertical widening of the board insertion port 41 can be restricted in this way, deformation of the upper and lower edge parts of the front wall portion 33 to bulge outwardly is also restricted and, consequently, the upper and lower supporting wall portions 31 are prevented from being curved and deformed. Since the supporting wall portions 31 can reliably receive reaction forces resulting from the resiliently pressing action of the resilient contact pieces 54 in this way, the contact pressure between the terminal fittings 50 and the circuit board 62 can be kept at a predetermined value.

Further, since the connecting edge portion 63 of the circuit board 62 is inserted into the board insertion port 41, the circuit board 62 may interfere with the coupling portion 44 to obstruct the connection of the two connectors H, P. However, since the connecting edge portion 63 of the circuit board 62 is formed with the cut portion 65 for avoiding interference with the coupling portion 44 in the inserting process into the board insertion port 40, the connection of the two connectors H, P is not obstructed.

Further, the front wall portion 33 constitutes the terminal accommodating chambers 38 for accommodating the plurality of terminal fittings 50. The coupling portion 44 and the cut portion 65 are engaged while being held in contact in the juxtaposition direction of the terminal fittings 50. According to this configuration, by the engagement of the coupling portion 44 and the cut portion 65, the plurality of contact portions 64 of the circuit board 62 and the resilient contact pieces 54 of the plurality of terminal fittings 50 are positioned in the juxtaposition direction of the terminal fittings 50. Thus, contact reliability is excellent. In addition, since the coupling portion 44 and the cut portion 65 is press-fitted and engaged, relative displacements of the circuit board 62 and the terminal fittings 50 are restricted not only in the lateral direction, but also in the front-back direction and the vertical direction. Therefore, even if the card edge connector receives vibration, the contact pressure between the terminal fittings 50 and the circuit board 62 is stable.

Further, the coupling portion 44 and the cut portion 65 is arranged at the position deviated from the central position of the long-side opening edges 43 in the length direction. According to this configuration, if an attempt is made to insert the circuit board 62 in a laterally inverted incorrect posture into the board insertion port 41, the circuit board 62 interferes with the coupling portion 44, wherefore the insertion of the circuit board 62 in an incorrect posture can be prevented.

Further, the harness-side housing 10 includes the terminal accommodating portion 39 for accommodating the plurality of terminal fittings 50 while positioning them in the juxtaposition direction. At least a part (terminal holding member 30) of the terminal accommodating portion 39 is made of the material (PPS resin) having a linear expansion coefficient substantially equal to that of the material (glass epoxy resin) of the circuit board 62. According to this configuration, when the card edge connector becomes hot, the arrangement interval of the terminal fittings 50 and that of the contact portions 64 of the circuit board 62 are unlikely to deviate from each other. Thus, the card edge connector of this embodiment is excellent in contact reliability.

Further, the terminal accommodating portion 39 includes the housing main body 11 and the terminal holding member 30. The housing main body 11 is formed with the locking lances 18 resiliently deflectable to retain the terminal fittings 50. The terminal holding member 30 is a body separate from the housing main body 11 and made of the material having a linear expansion coefficient approximately equal to that of the circuit board 62. According to this configuration, the terminal fittings 50 can be reliably retained by the resiliently deflectable locking lances 18 while suppressing a deviation between the arrangement interval of the contact portions 64 of the circuit board 62 and that of the terminal fittings 50 during thermal expansion and contraction.

Further, the terminal fitting 50 includes the resilient contact piece 54 to be resiliently brought into contact with the contact portion 64 of the circuit board 62. The terminal holding member 30 holds the terminal fittings 50 while positioning at least parts of the terminal fittings 50 corresponding to the resilient contact pieces 54 in the juxtaposition direction. According to this configuration, a deviation between the arrangement interval of the resilient contact pieces 54 and that of the contact portions 64 during thermal expansion and contraction can be effectively suppressed.

Further, the terminal holding member 30 constituting the front end of the terminal accommodating portion 39 and the main body portion 12 constituting the rear end side of the terminal accommodating portion 39 have different linear expansion coefficients. Thus, in the process of thermal expansion and contraction, a displacement amount in the lateral direction differs between the front end side and the rear end side of the terminal fitting 50. As a result, the terminal fitting 50 may be inclined in the lateral direction. However, in this embodiment, the front end side part of the terminal fitting 50 serves as the box portion 51 for holding the resilient contact piece 54 and this box portion 51 is held over the entire length thereof while being positioned in the juxtaposition direction by the terminal holding member 30. Thus, the orientation of the terminal fitting 50 is kept constant by the terminal holding member 30 in the process of thermal expansion and contraction.

Further, the board-side housing 60 is accommodated over the entire length thereof in the receptacle 13 in the state where the both connectors H, P are properly connected. That is, the entire board-side housing 60 is accommodated in the receptacle 13. This structure enables position shifts between the housings 10 and 60 due to vibration to be suppressed also in a state where the cap 46 and the resilient member 49 are not assembled yet as compared with the case where a projecting distance of the receptacle 13 is short and only a part of the board-side housing 60 is accommodated in the receptacle 13.

Further, the card edge connector of this embodiment can be used without assembling the cap 46 and the resilient member 49 in the state where the harness-side connector H and the board-side connector P are connected. In this case, position shifts between the housings 10 and 60 due to vibration can be more effectively suppressed or more reliably prevented if the two housings 10, 60 are fixed so as not to move relative to each other such as by mounting a fixing member made of rubber (not shown) on the harness-side housing 10 and the board-side housing 60. As a means for reliably preventing position shifts between the housings 10 and 60 without assembling the cap 46 and the resilient member 49, the two housings 10, 60 may be fixed to a body of a vehicle (not shown) by common bolts (not shown). As just described, the card edge connector of this embodiment can suppress or prevent position shifts between the two housings 10 and 60 due to vibration by being combined with another means instead of the cap 46 and the resilient member 49.

The present invention is not limited to the above described and illustrated embodiment. For example, the following embodiments are also included in the technical scope of the present invention.

In the above embodiment, the housing accommodating portion is composed of the receptacle integrally formed to the terminal accommodating portion and the cap for closing the opening of the receptacle. However, the housing accommodating portion may be an integral assembly of the receptacle of the embodiment separated from the terminal accommodating portion and the cap and have a bottomed tubular shape.

Although the resilient member is arranged between the rear surface of the board-side housing in the receptacle and the inner surface of the cap in the above embodiment, it may be arranged between the front surface of the terminal accommodating portion and the front surface (surface facing the terminal accommodating portion) of the board-side housing.

Although the resilient member is a component separate from the housing accommodating portion in the above embodiment, it may be integrally formed to the component (e.g. cap) constituting the housing accommodating portion.

Although the board-side housing is integrated with the circuit board by molding in the above embodiment, the pre-molded board-side housing and the pre-molded circuit board may be assembled.

Although the terminal fittings are in contact with both sides of the circuit board in the above embodiment, the present invention can also be applied to a card edge connector in which terminal fittings are in contact only with one of both sides of a circuit board.

Although the coupling portion is arranged at the position deviated from the central position of the long-side opening edges in the length direction and the two opening areas divided by the coupling portion are laterally asymmetrical in the above embodiment, the coupling portion may be arranged at the central position of the long-side opening edges in the length direction and the two opening areas divided by the coupling portion may be bilaterally symmetrical.

LIST OF REFERENCE NUMERALS

H . . . harness-side connector
P . . . board-side connector
10 . . . harness-side housing
13 . . . receptacle
39 . . . terminal accommodating portion
39F . . . front surface of terminal accommodating portion
46 . . . cap
48 . . . housing accommodating portion
49 . . . resilient member
50 . . . terminal fitting
60 . . . board-side housing
60F . . . front surface of board-side housing
60R . . . rear surface of board-side housing
62 . . . circuit board
63 . . . connecting edge portion
64 . . . contact portion

The invention claimed is:

1. A card edge connector with a harness-side connector in which a plurality of terminal fittings are arranged side by side in a harness-side housing and a board-side connector in which a connecting edge portion of a circuit board projects from a front surface of a board-side housing, the plurality of terminal fittings being resiliently brought into contact with a plurality of contact portions arranged side by side on the connecting edge portion when the board-side housing is connected to the harness-side housing from front of the harness-side housing, comprising:

a terminal accommodating portion constituting the harness-side housing and configured to accommodate the plurality of terminal fittings;

a housing accommodating portion constituting the harness-side housing, arranged to face a front surface of the terminal accommodating portion and configured to accommodate the board-side housing connected to the harness-side housing; and a resilient member provided in the housing accommodating portion and configured to bias the terminal accommodating portion and the board-side housing in a direction toward or away from each other in parallel to a connecting direction.

2. A card edge connector according to claim 1, wherein the housing accommodating portion includes a receptacle integrated with the terminal accommodating portion and projecting forwardly of the terminal accommodating portion and a cap to be mounted on the receptacle to close an opening on a front end of the receptacle.

3. A card edge connector according to claim 2, wherein the resilient member is arranged between a rear surface of the board-side housing in the receptacle and an inner surface of the cap.

4. A card edge connector according to claim 1, wherein the resilient member is a component separate from the housing accommodating portion and accommodated in the housing accommodating portion.

5. A card edge connector according to claim 1, wherein the board-side housing is integrated with the circuit board by molding.

6. A card edge connector according to claim 1, wherein:

the housing accommodating portion includes a receptacle integrated with the terminal accommodating portion and projecting forwardly of the terminal accommodating portion; and the entire board-side housing is accommodated in the receptacle in a state where the harness-side connector and the board-side connector are properly connected.

* * * * *